US005307726A

United States Patent [19]

Stubbs

[11] Patent Number: 5,307,726

[45] Date of Patent: May 3, 1994

[54] AMMUNITION FEED APPARATUS

[75] Inventor: George J. Stubbs, Bexley Heath, England

[73] Assignee: The Secretary of State for Defense in Her Britannic Majesty's Government of the United Kingdom of Great Britain and Northern Ireland, London, England

[21] Appl. No.: 398,335

[22] Filed: Jul. 7, 1982

[30] Foreign Application Priority Data

Jul. 9, 1981 [GB] United Kingdom ..... 8121255

[51] Int. Cl.[5] ..... F41A 9/16

[52] U.S. Cl. ..... 89/36.13; 89/45

[58] Field of Search ..... 89/33 A, 33 B, 36 H, 89/36 K, 45, 33.05, 33.1, 36.08, 36.13

[56] References Cited

U.S. PATENT DOCUMENTS

| | | | |
|---|---|---|---|
| 709,781 | 9/1902 | Krone | 89/45 |
| 2,594,198 | 4/1952 | Motley | 89/36 K |
| 3,937,125 | 2/1976 | Eriksson | 89/45 |

FOREIGN PATENT DOCUMENTS

| | | | |
|---|---|---|---|
| 11461 | of 1896 | United Kingdom | 89/45 |

*Primary Examiner*—Stephen C. Bentley
*Attorney, Agent, or Firm*—Cushman, Darby & Cushman

[57] ABSTRACT

A gravity operated shell feed apparatus for a turret-mounted gun comprises two stacks of downwardly sloping magazine racks, from the lower ends of which shell may be singly released to roll into an appropriately positioned collection tray which is then angularly deflected in a vertical plane so as to transfer the shell to a ramming tray for delivery to a ramming position at the gun, the whole sequence being manually controlled by means of a single operating lever.

The apparatus is designed for a fixed loading position thereby avoiding the necessity of sweeping the feed apparatus at high speed through a large volume of turret space, and using instead the elevating gear of the gun to sweep the balanced elevating mass through a smaller turret volume at a proportionately lower speed, in a region less hazardous to the gun crew.

9 Claims, 8 Drawing Sheets

Figure 1:
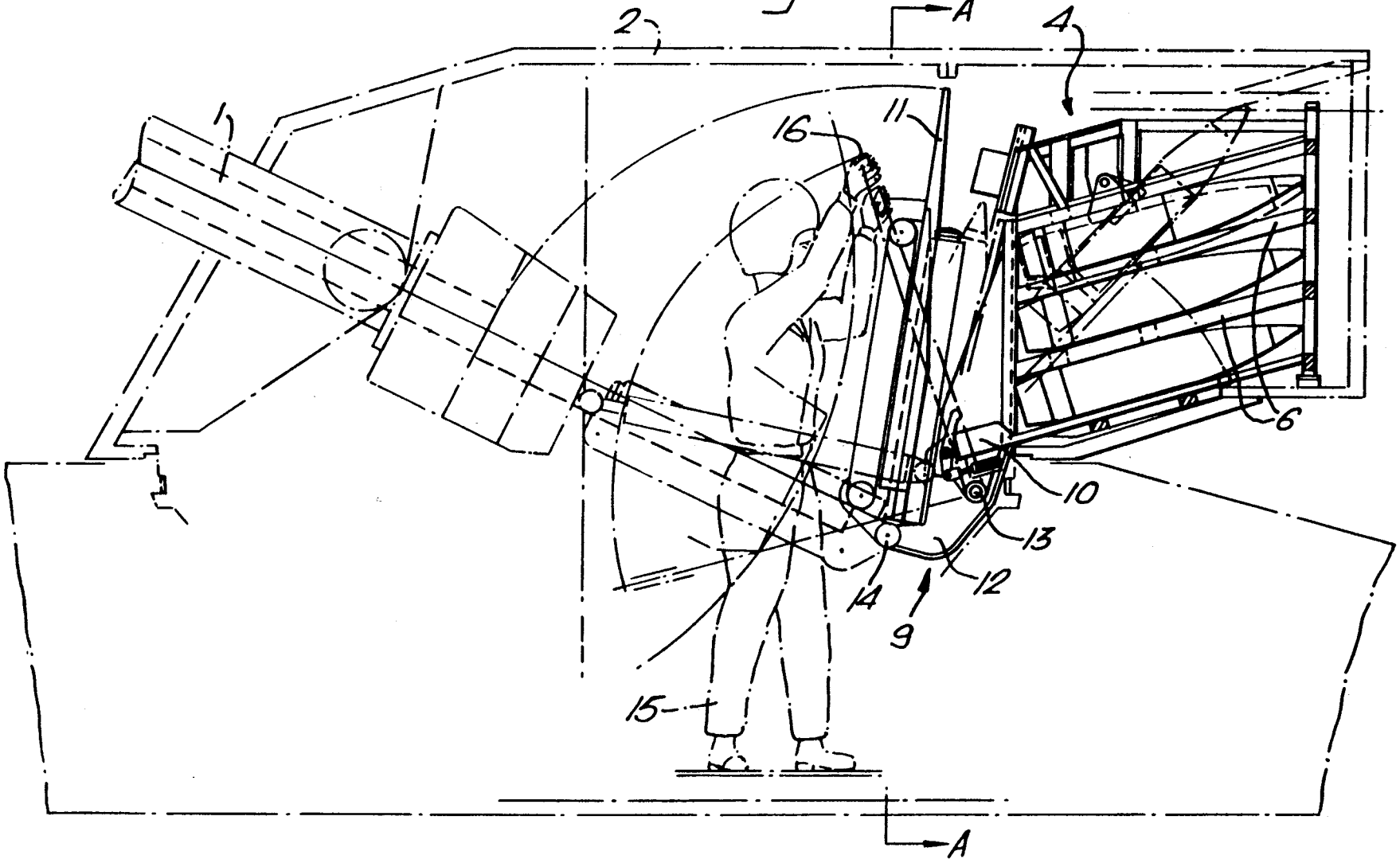

A
A
1
2
4
6
9
10
11
12
13
14
15
16

AMMUNITION FEED APPARATUS

This invention relates to ammunition feed apparatus for a turret-mounted gun which is, in particular but not exclusively, self-propelled.

Manual loading of a heavy gun can be laborious and slow and various automated systems are known for improving the loading process. These in general employ a magazine capable of holding a plurality of ammunition rounds, a transfer mechanism for shifting each round from the magazine to a ramming position and may include a magazine replenishment device, all or any of which may be hydraulically or electrically operated and manually or electronically controlled.

Such systems have a higher fire rate and fire capacity than a wholly manual system but are of increased complexity, often demanding maintenance skills which are not readily available under the arduous conditions in which they are required to operate. Furthermore the heavy moving parts frequently associated with such automated systems can be hazardous to a gun crew operating in a confined space such as the turret of an armoured vehicle.

Gravity operated feed systems are also know, UK Patent Specification No. 1470716 for example, which are less complex but these too are not in general suitable for use with a large gun that is loaded and fired from within a turret.

The present invention seeks to provide a manually controlled, gravity operated feed apparatus having a comparatively high fire rate and fire capacity, which is safe to operate within a turret and simple to maintain.

According to the present invention an ammunition feed apparatus for a turret-mounted gun having a barrel and an axial breech and including a magazine having at least one stack of two or more inclined plane-parallel racks each spaced away from its neighbour by a distance of approximately one calibre to define a compartment adapted to contain a single row of ammunition rounds lying with their cylindrical axes parallel with a lower end of the compartment, a plurality of escapement mechanisms disposed within each compartment adapted to separate and to control rolling of contained rounds towards the lower end, and a release mechanism located adjacent to the lower end of each compartment; is characterised in that the magazine is attached to the turret rearwardly of the breech with the lower end of each compartment disposed adjacent and parallel to a substantially vertical plane containing the axis of the barrel, and includes a transfer means for collecting a round released from the lower end of any selected one of the compartments and for presenting that round in a ramming position at the breech, which means is pivotally attached to the magazine intermediate the compartments and the breech so as to be angularly deflectable in the said vertical plane, the rounds being housed in use within the compartments with their bases directed towards the breech.

The transfer means may comprise a collection tray and a confronting ramming tray each pivotally attached at one end to the magazine so as to be deflectable within an upwardly extending sector of the said plane substantially defined by the axis of the barrel and the lowest rack of the magazine.

The magazine preferably has two symmetrically arranged stacks, the racks of each being disposed to decline mutually inwardly towards a central slot adapted for receiving the collection tray.

Replenishment means may be additionally provided for each magazine stack, including an ammunition round carrier and an actuating means, the carrier being pivotable from a manual loading position to an entry position adjacent the magazine, in which position the carrier is similarly inclined to the horizontal to permit gravitational transfer of rounds into the magazine.

Figure 2:
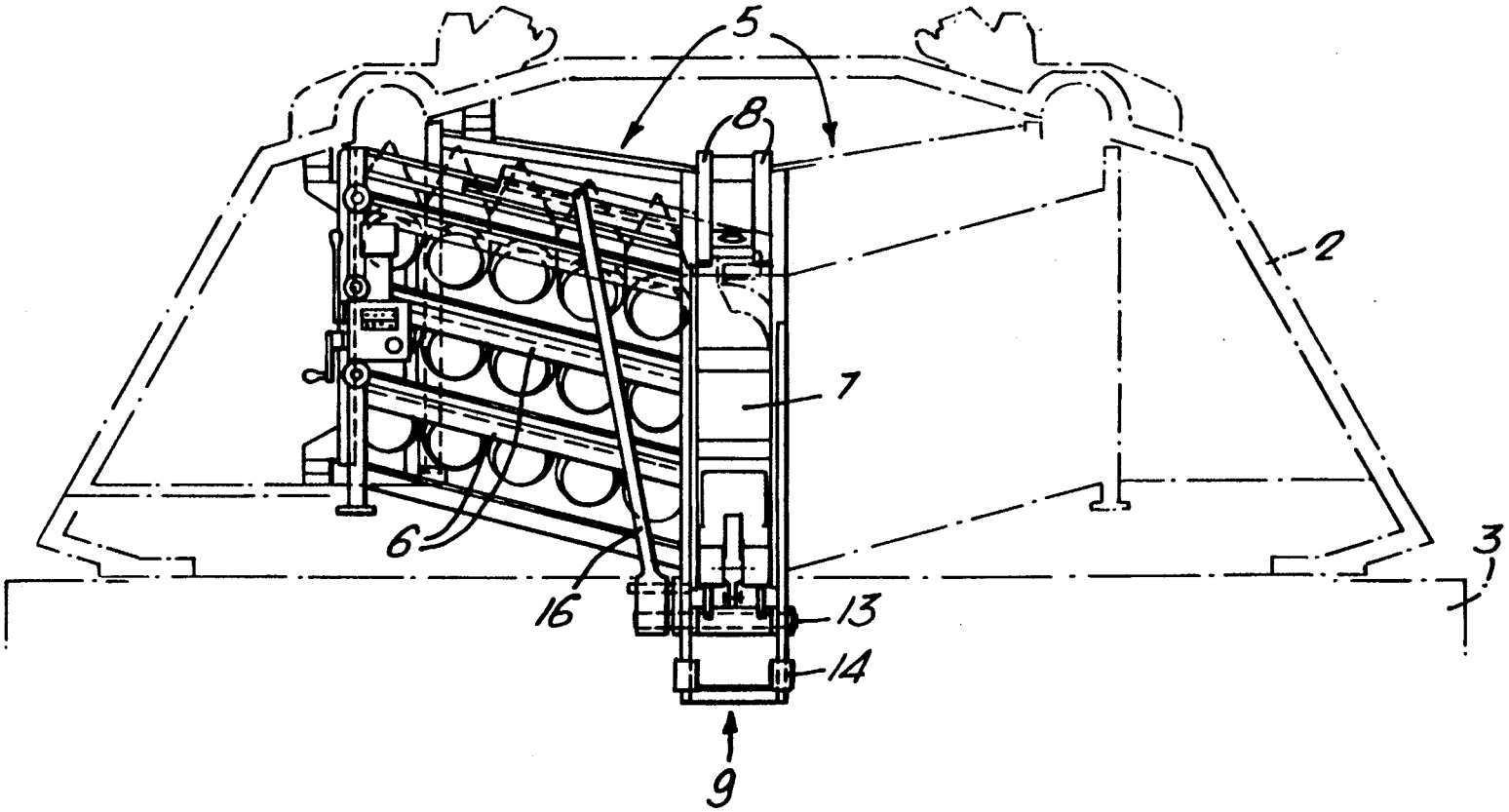
Figure 3:
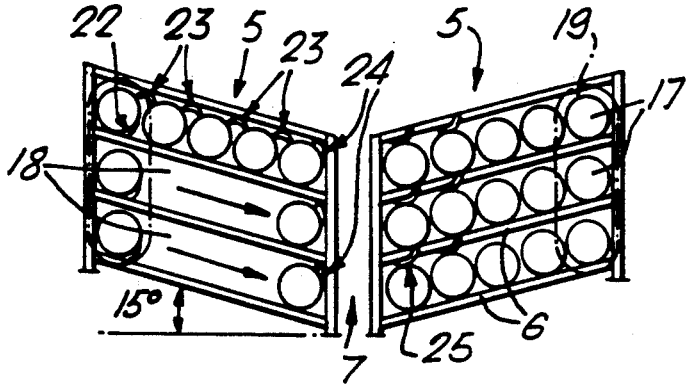
Figure 4:
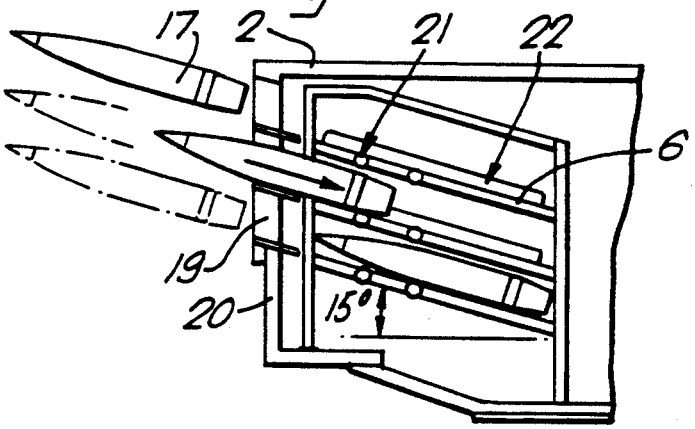
Figure 6:
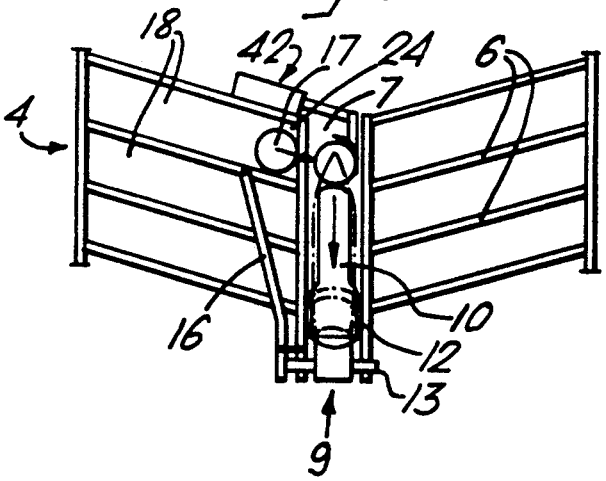
Figure 7:
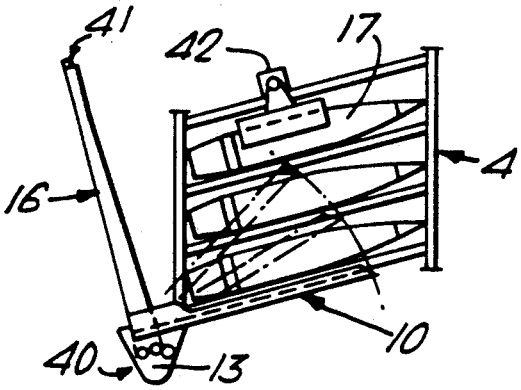
Figure 5:
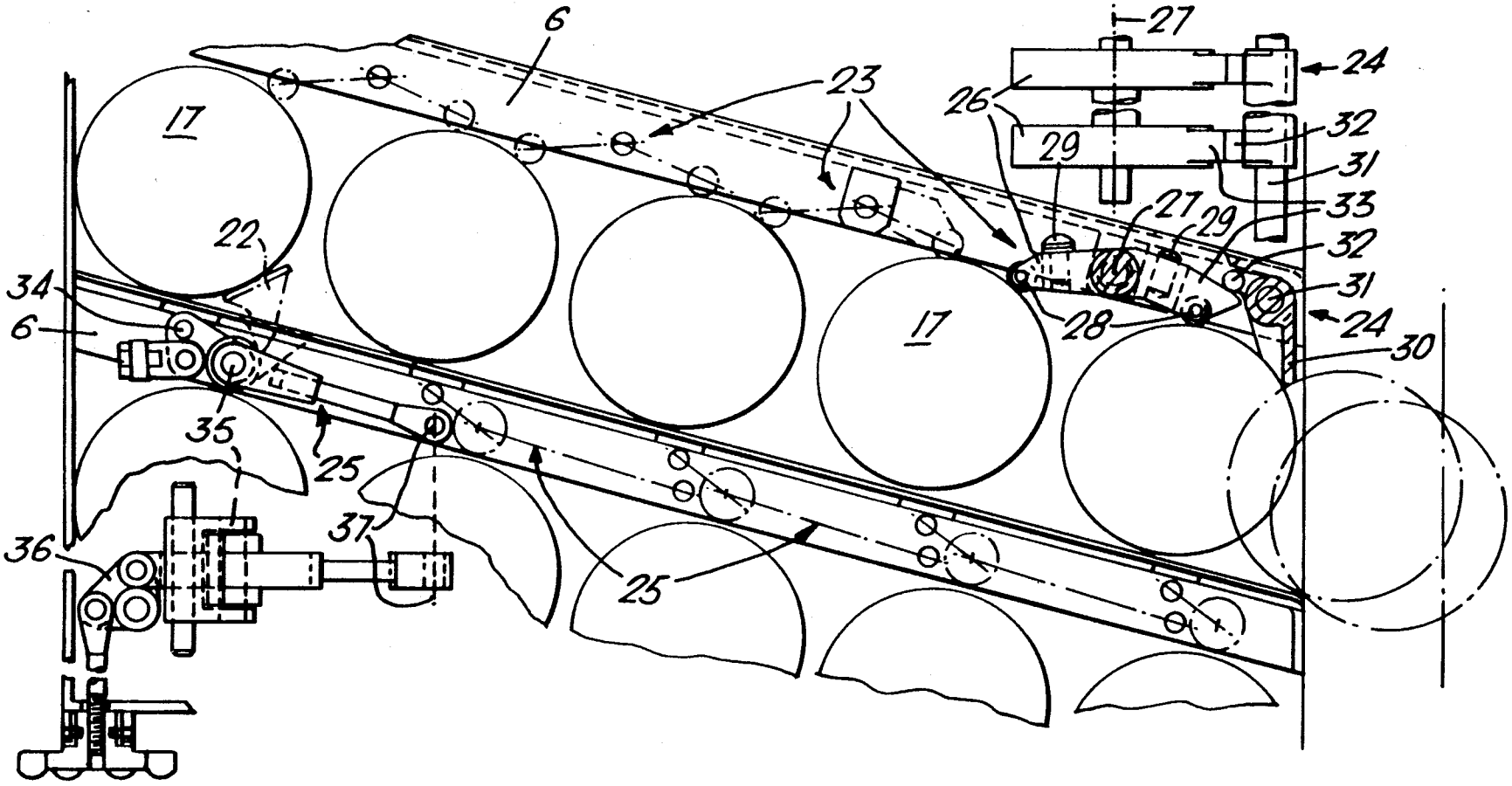
Figure 12:
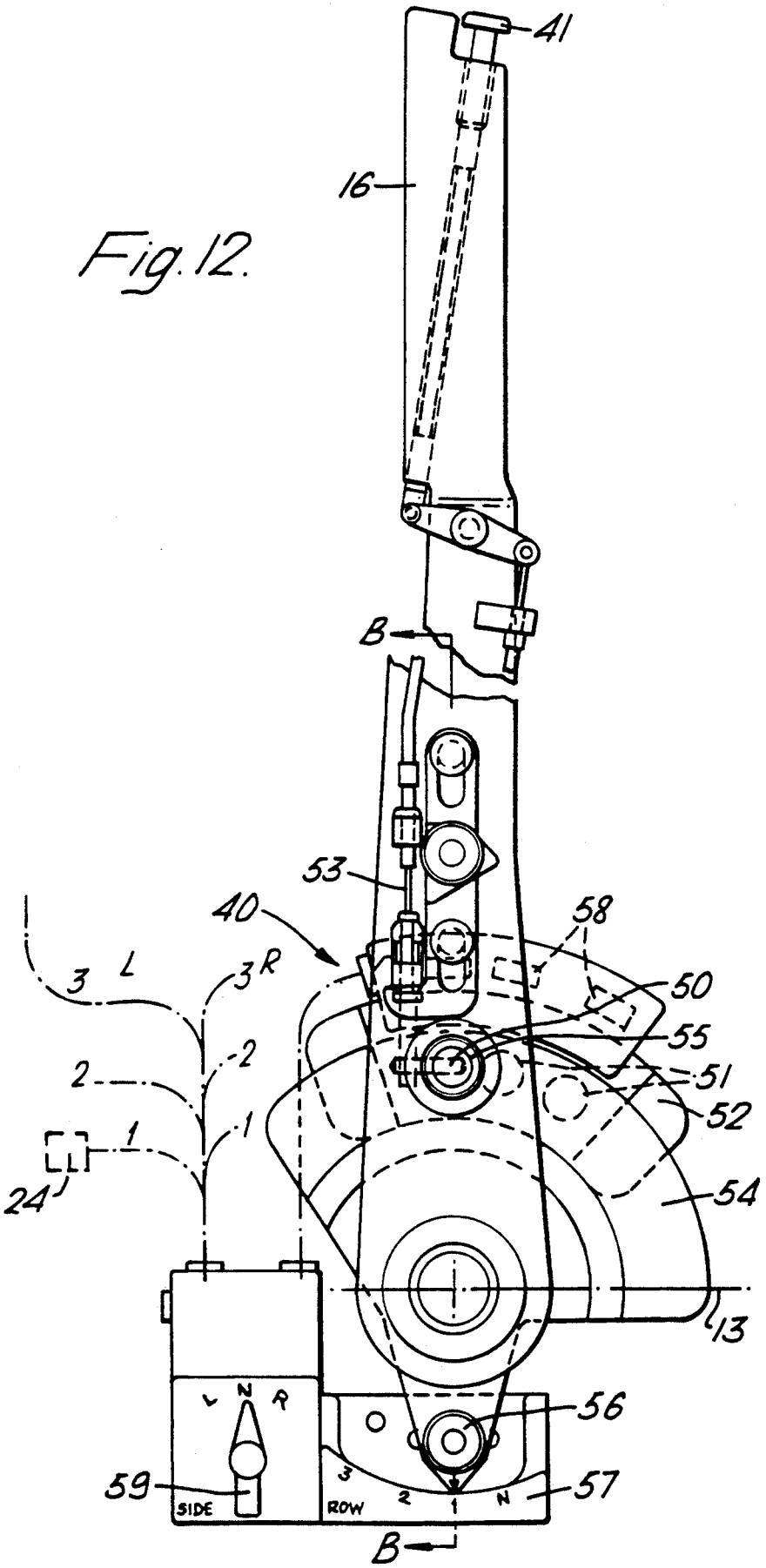
Figure 13:
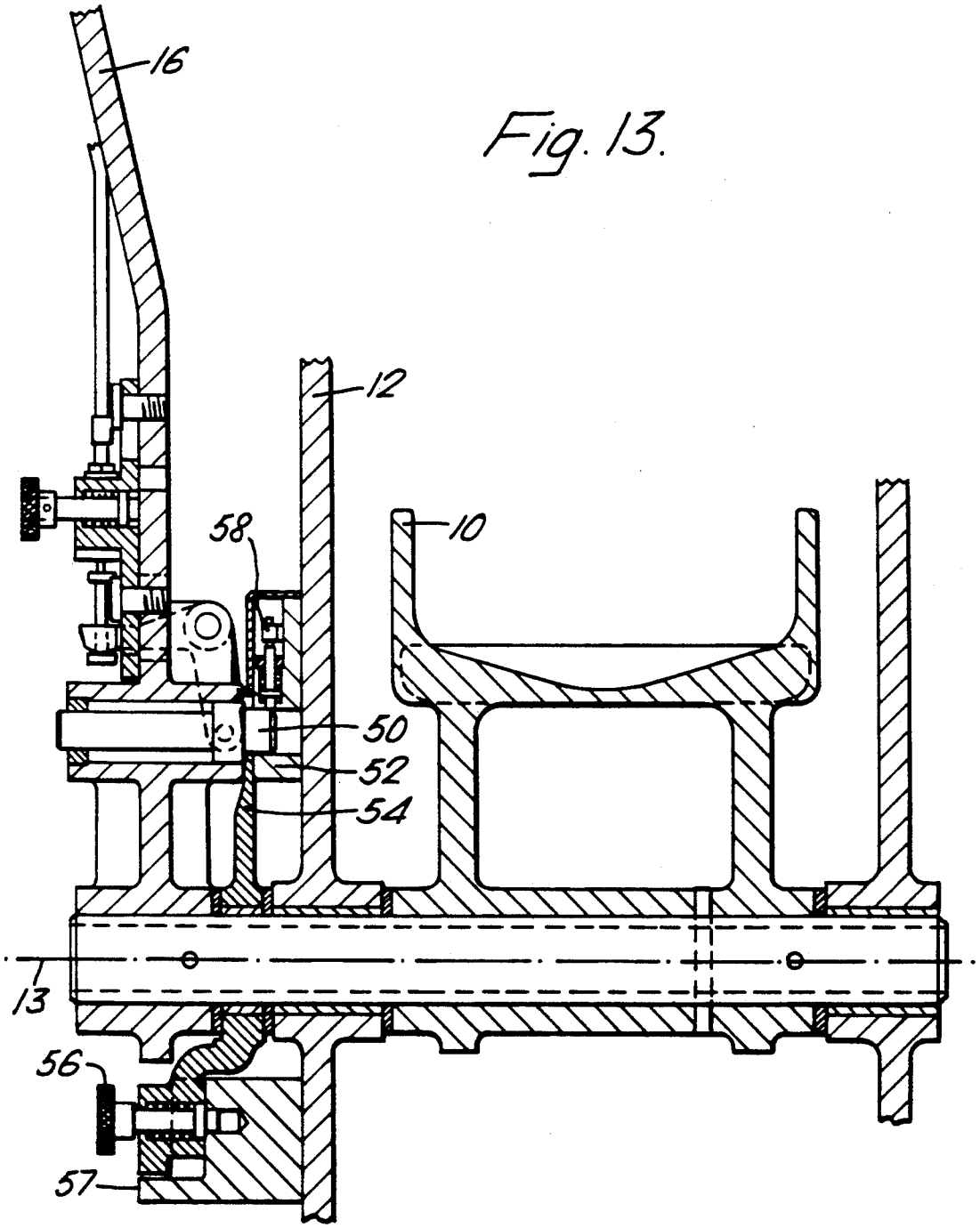

An embodiment of the invention will now be described by way of example, with reference to the accompanying drawings of which FIG. 1 is a side view of a shell feed apparatus for a vehicle-mounted gun, FIG. 2 is a front view of the same shell feed apparatus looking rearwards from the line A—A of FIG. 1, FIGS. 3 and 4 are simplified front and side views respectively of the magazine illustrated in FIGS. 1 and 2, FIG. 5 is a transverse section of one compartment of the same magazine illustrating details of a release mechanism and an escapement mechanism, FIGS. 6 and 7 are simplified front and side views respectively of the same magazine illustrating initial operation of the transfer means of FIGS. 1 and 2, FIGS. 8 to 11 are simplified side views of the same transfer means sequentially illustrating further operation thereof, FIG. 12 is a detailed illustration of the operating handle of the same transfer means, FIG. 13 is a section of the same operating handle taken on the line B—B of FIG. 12, and FIGS. 14 to 16 are simplified top, back and side views of a replenishment means for the magazine illustrated in FIGS. 1 and 2.

The shell feed apparatus illustrated in FIGS. 1 and 2 is designed for use in conjunction with a gun barrel 1 mounted in a gun turret 2 which is rotatable upon a vehicle chassis 3. A magazine 4 is rigidly attached to the gun turret 2 rearward of the gun barrel 1 and comprises two vertical stacks 5 of rectangular shell racks 6 symmetrically disposed on either side of a central slot located in the vertical axial plane of the gun barrel 1 and defined by two side frames 8. The shell racks 6 of each stack 5 are inclined to the horizontal at a compound angle providing a 15° downward slope both towards the central slot 7 and towards the gun barrel 1.

A shell transfer means 9 intermediate the magazine 4 and the gun barrel 1, comprises a collection tray 10 and a ramming tray 11 each pivoted adjacent one end between two forward-protruding brackets 12 of the frames 8 at the pivots 13 and 14 respectively so as to be rotatable within the plane of the central slot 7. Rotation of the collection tray 10 is controlled by a crewman 15 via a handle 16 rigidly attached to the collection tray 10, the ramming tray 11 being normally biased to an approximately upright position by means of a spring cylinder (not shown).

The internal arrangement of the magazine 4 is illustrated in simplified form in FIGS. 3 and 4. Shells 17 are entered axially, base first, into the upper end of each magazine compartment 18 via an entry hatch 19 in a rear wall 20 of the gun turret 2, gravitational movement into the magazine being assisted by rollers 21 located in the supporting racks 6. A movable guide rail 22 ensures that each shell remains parallel with the lower end of the compartment 18 adjacent the central slot 7 after entry, and escapement mechanisms 23 are located in train along each overhead rack 6 to control and separate the shells as, upon removal of the guide rail 22, they roll down the racks towards the lower end of the compartment where the first shell entered is retained by a release mechanism 24. Shell travel clamps 25 are also provided for securing the shells when the vehicle is in transit.

These magazine components are illustrated in detail in FIG. 5 wherein each escapement mechanism 23 consists of a rocker are 26 freely pivoted at a pivot 27, and having two end rollers 28 each of which engage with one of two adjacent shells 17. Back stops 29 are attached to each rocker arm 26 which react in operation with the supporting rack 6.

The release mechanism 24 comprises a stop rail 30 rotatable about a pivot 31. The release mechanism 24 also supports two interlock rollers 32 which engage with corresponding tongues 33 attached to the adjacent first pair of rocker arms 28. Upon operation of the release mechanism 24 to release one shell, all the remaining shells in the compartment 18 automatically index down one position defined by the rocker arms 28.

The guide rail 22 is raised or lowered with respect to the rack 6 by rotation about a pivot 34, and the shell travel clamps 25 are each provided with a toggle joint 35 which can be forced into contact with the adjacent shell 17 by rotation of a cam 36, the two ends of the particular clamp 25 illustrated being rotatably attached to the rack 6 at the pivot 34 and a pivot 37 respectively.

The arrangement of the shell transfer means 9 is now described with reference to FIGS. 6 and 7. The handle 16 is used by the crewman to rotate the collection tray 10 to any selected one of three levels appropriated for receiving a shell released by the release means 24 from any of the compartments 18, correct registration being achieved by means of a shell selection mechanism 40 which is disengageable by means of a disengagement button 41.

Figure 8:
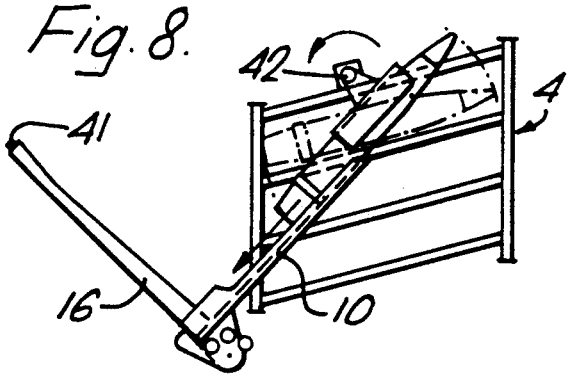

The shells are allowed to fall and tilt naturally into the collector tray 10 from the compartments 18 at the bottom and middle levels but at the top level, where the angle of inclincation of the tray 10 with respect to the rack is greatest, a spring-loaded shell restrainer 42 is provided to control the tilting of the shell during its fall into the tray (see also FIG. 8).

Figure 9:
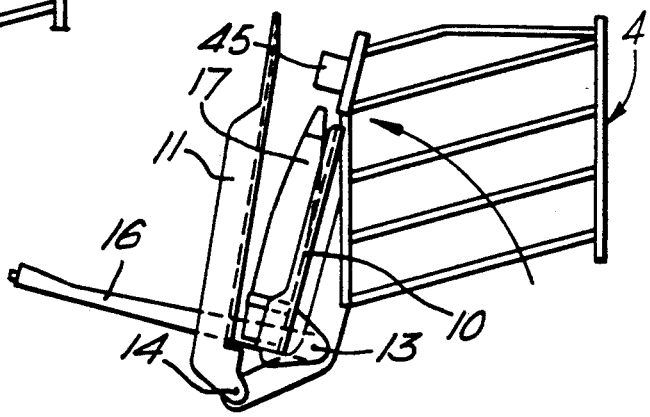
Figure 10:
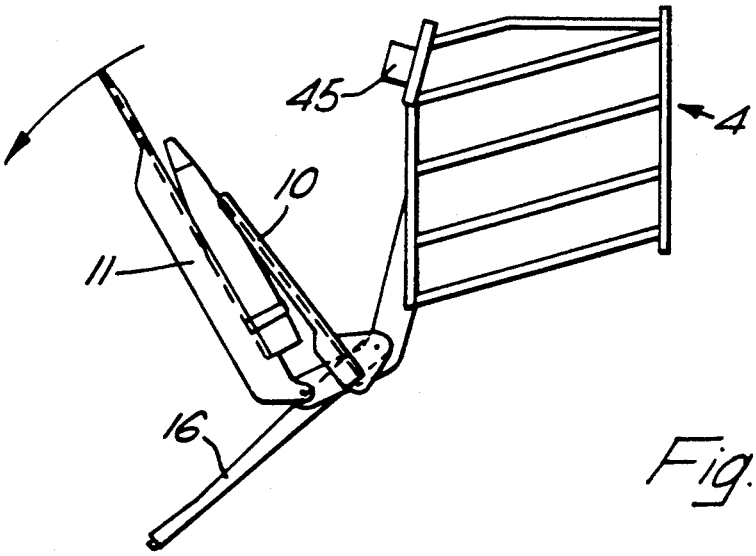
Figure 11:
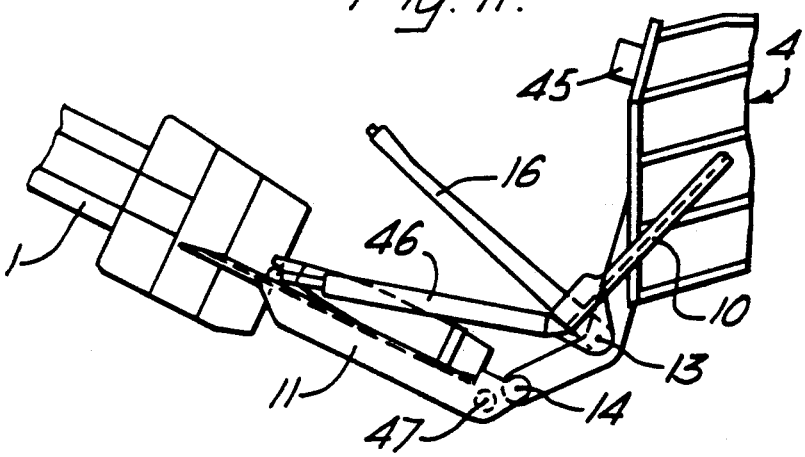

Once a tray has dropped into the collection tray 10, its mode of transfer to a ramming position is a illustrated sequentially in FIGS. 8 to 11. After releasing the disengagement button 41 the crewman further rotates the handle 16 to bring the collection tray 10 and the shell into a nearly upright position in alignment with a fuse-setting head 45 attached to the magazine 4, where the fuse is set (FIG. 9). The collection tray 10 is then further rotated to meet the ramming tray 11 into which tray the shell gravitationally transfers during continued rotation through the vertical (FIG. 10), whereupon the ramming tray 11 pivots downward against the action of a spring cylinder 46 (FIG. 11) into a ramming position where it is held at a fixed loading angle by the action of a spring loaded plunger 47. Meanwhile the gun barrel 1 has been brought to a corresponding loading angle permitting the shell to be loaded into the breech by conventional ramming means (not shown).

Operative details of the handle 16 are illustrated in FIGS. 12 and 13. The shell selection mechanism 40 located at the base of the handle 16 comprises a spring loaded plunger 50 attached to the handle which plunger is engageable with any one of three locating holes 51 in a plate 52 attached to the bracket 12. The plunger 50 is withdrawable from the plate 52 by means of a cable 53 upon depression of the disengagement button 41. A selector plate 54, interposed between the plunger 50 and the plate 52, is rotatable upon the same axis as the handle i.e. the pivot 13, and is provided with a single locating hole 55 alignable with any one of the three locating holes 51. A setting knob 56 is provided on the selector plate 54 which knob is set by the crewman with reference to an indicator panel 57. Upon rotation of the handle 16, entry of the plunger 50 into the selected locating hole 51 also actuates a detent mechanism 58 releasing either one of the two release mechanism 24 (FIG. 5) located at the associated level, respectively left and right of the central slot 7. Operative interconnection between each detent mechanism 58 and its associated release mechanism 24 is achieved electrically via a Left/Right selector switch 59, rotation of the stop rail 30 of the release mechanism 24 being accomplished by means of a solenoid (not shown).

Figure 14:
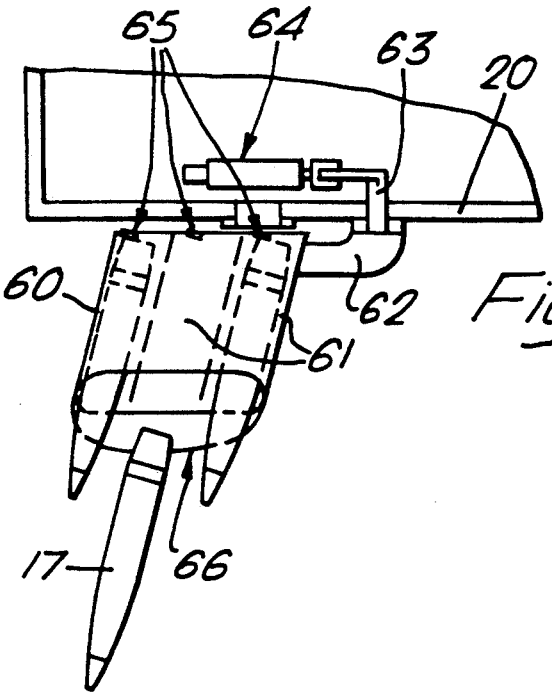
Figure 15:
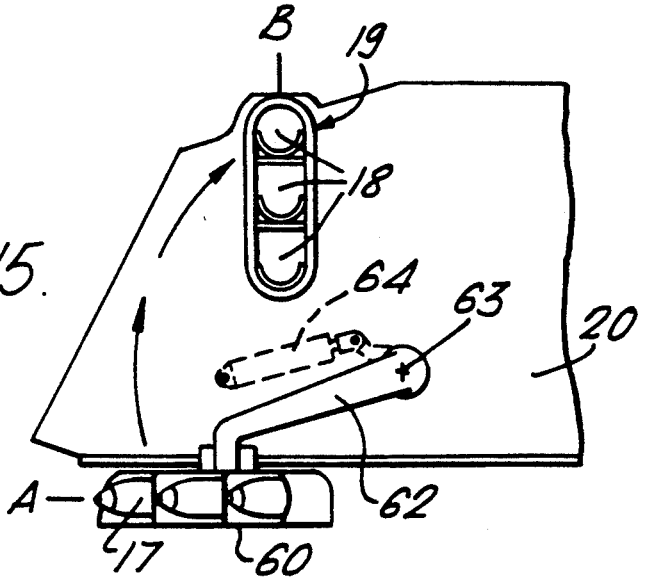
Figure 16:
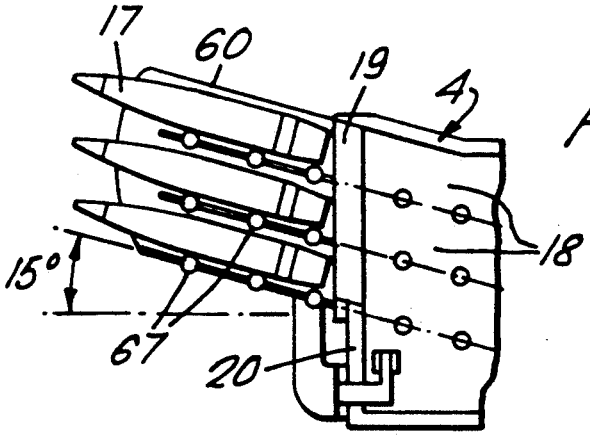

An optional addition to the above described shell feed apparatus is that of a magazine replenishment means as illustrated in FIGS. 14 to 16, one being provided for each stack of the magazine. A shell carrier 60, sub-divided into three open-ended, single shell compartments 61, is supported at one end of an arm 62 the other end of which is rotatably attached to the outside of the turret rear wall 20 at a pivot 63 so that the carrier is rotatable in a plane parallel with the wall 20. The carrier 60, which is rotatable by means of a hydraulic cylinder 64 mounted within the turret rear wall 20, may be lowered about the pivot 63 to a position A for manual loading with shell 17. When loaded the carrier is raised about the pivot 63 to a position B adjacent the entry hatch 19, wherein each of the three compartments 61 is inclined to the horizontal at 15° and is in alignment with one of the upper stations of the compartments 18 at the three levels of the magazine 4.

Each compartment 61 is provided with a shell retaining catch 65 at its end adjacent the rear wall 20, and a soft beating pad 66 at the other end. Rollers 67 are provided within each compartment 61 to assist gravitational transfer of the shells from the compartments 61 to the compartments 18 when the retaining catch 65 is removed.

The above described example of a shell feed apparatus is designed for a fixed loading position thereby avoiding the necessity of sweeping the feed apparatus at high speed through a large volume of the turret crew space, and using instead the elevating gear of the gun to sweep the balanced elevating mass through a smaller turret volume at proportionally lower speed, in a region of minimum hazard to the crew.

The 15° inclination of the magazine racks in the direction both of shell sliding and of shell rolling ensures sufficient potential energy for efficient operation of the gravitational feed system upon sloping ground of up to 10° inclination in any direction.

I claim:

1. An ammunition feed apparatus for a turret-mounted gun having a barrel with an axial breech and including a magazine having at least one stack of two or more inclined plane-parallel racks each spaced away from its neighbour by a distance of approximately one calibre to define a compartment adapted to contain a single row of ammunition rounds lying with their cylindrical axes parallel with a lower end of the compartment, a plurality of escapement mechanisms disposed within each compartment and adapted to separate and control rolling of contained rounds towards the lower end, and a release mechanism located adjacent the lower end of each compartment; wherein the invention comprises that the magazine is attached to the turret rearwardly of the breech with the lower end of each compartment disposed adjacent and parallel to a substantially vertical plane containing the axis of the barrel, and includes a transfer means for collecting a round released from the lower end of any selected one of the compartments and for presenting that round in a ramming position at the breech, which transfer means is pivotally attached to the magazine intermediate the compartments and the breech so as to be angularly deflectable in the said vertical plane, the rounds being housed in use within the compartments with their based directed towards the breech.

2. An apparatus as claimed in claim 1 wherein the transfer means comprises a collection tray and a confronting ramming tray each pivotally attached at one end to the magazine so as to be deflectable within an upwardly extending sector of the said plane substantially defined by the axis of the barrel and the lowest rack of the magazine.

3. An apparatus as claimed in claim 2 wherein the magazine has two symmetrically arranged stacks, the racks of each being disposed to decline mutually inwardly towards a central slot adapted for receiving the collection tray.

4. An apparatus as claimed in claim 1 wherein the transfer means is provided with a manually operated rotation lever and with a round selection mechanism controlled from a disengagement button located on the rotation lever.

5. An apparatus as claimed in claim 1 having a fuze setting head attached to the magazine adjacent the apex of the locus described by a fuze of a collected round during deflection to the ramming position.

6. An apparatus as claimed in claim 1 wherein the release mechanism comprises a stop rail arranged for rotation about a longitudinal axis parallel with the axis of the contained rounds.

7. An apparatus as claimed in claim 6 wherein the escapement mechanism comprises an intermediately pivoted rocker arm having a roller rotatably attached at each of its ends, the rollers being respectively engageable in rolling contact with two consecutive rounds, the escapement mechanism nearest to the release mechanism being interlocked therewith.

8. An apparatus as claimed in claim 1 wherein each compartment is provided with an entry hatch through a rear wall of the turret adjacent the upper end of the compartment, the racks additionally being declined forwardly therefrom so as to assist gravitational replenishment.

9. An apparatus as claimed in claim 8 further including a replenishment means comprising a round carrier attachable to the exterior of the turret and arranged for rotation to an entry position adjacent the entry hatches and aligned with the racks.

* * * * *